United States Patent [19]

Wolf et al.

[11] 4,095,947

[45] Jun. 20, 1978

[54] RECOVERY OF SIZES

[75] Inventors: Hans Wolf, Ludwigshafen; Heinz Leitner, Mannheim; Wolfgang Schenk, Schwetzingen, all of Germany

[73] Assignee: BASF Aktiengesellschaft, Ludwigshafen am Rhein, Germany

[21] Appl. No.: 722,519

[22] Filed: Sep. 13, 1976

[30] Foreign Application Priority Data

Oct. 1, 1975 Germany ..... 2543815

[51] Int. Cl.[2] ..... D01C 3/02; D06L 1/06

[52] U.S. Cl. ..... 8/138; 8/141; 8/158; 28/178

[58] Field of Search ..... 28/72.6, 178; 8/138, 8/158

[56] References Cited

U.S. PATENT DOCUMENTS

| | | | |
|---|---|---|---|
| 246,547 | 8/1881 | Patterson et al. | 68/5.4 |
| 3,682,583 | 8/1972 | Kravetz et al. | 8/138 |
| 3,723,381 | 3/1973 | Corey et al. | 260/33.8 UA |
| 3,922,461 | 11/1975 | Corey et al. | 428/265 |
| 3,960,485 | 6/1976 | Fantl et al. | 8/138 |

FOREIGN PATENT DOCUMENTS

| | | |
|---|---|---|
| 2,004,676 | 8/1971 | Germany. |
| 1,324,139 | 7/1973 | United Kingdom. |

*Primary Examiner*—A. Lionel Clingman

*Attorney, Agent, or Firm*—Keil, Thompson & Shurtleff

[57] ABSTRACT

Fabrics of which the warp is sized with water-soluble polymers of acrylic acid and/or their alkali metal salts or ammonium salts, are desized by treating the sized fabric with from 30 to 300 percent by weight of water, based on the dry weight of the fabric, and separating the resulting size solution from the fabric. The recovered size solution can be directly re-used for sizing.

10 Claims, No Drawings

RECOVERY OF SIZES

The present invention relates to a process for recovering sizes from fabrics of which the warp is sized with water-soluble polymers of acrylic acid.

It is general practice in the textile industry, before combining the warp with the filling to produce a fabric, to finish the warp and glue its constituents together, so that the warp shall withstand more successfully the mechanical stress to which it is subjected on the loom. This treatment is described as sizing. The principal sizes used are aqueous preparations of natural and chemically modified vegetable starches, e.g. potato starch, corn starch and rice starch, and/or chemically modified cellulose, but albuminous starch is also used. Fully synthetic sizes, in particular polyvinyl alcohol and polyacrylates, are also used, alone or together with other sizes. They are distinguished by particularly high adhesiveness.

Before the fabric is subjected to further finishing processes, e.g. bleaching and dyeing, the sizes must again be removed from the fabric as thoroughly as possible. This process is described as desizing. For this purpose, various assistants are employed, e.g. enzymes, detergents and wetting agents, alkali and, in every case, relatively large amounts of water. To remove the size, the fabric has to be swollen by, and exposed to, the assistants for a long period, as a rule for from 1 to 24 hours. The size remnants washed out, after the treatment with the assistants, by means of large amounts of water (up to fifty times the weight of the goods) cannot be re-used as sizes, because they are highly diluted and contaminated or because they have undergone chemical change. Instead, these desizing liquors are, in every case, discharged as effluent, and can account for up to 80% of the biological load in textile effluents (A. Stiebert, 2nd Reutlingen Colloguium on Sizing, 28/29.4.1975 "Versuche zur Berechnung der pauschalen Abwasserlast eines Textilveredlungsbetriebes").

When polyvinyl alcohol is used alone, it has already proved feasible to recover sizes from the desizing liquors by precipitation or evaporation. However, for industrial realization of these processes, large amounts of water are again required, together with considerable expenditure in respect of energy, chemicals, equipment and time (Textile World 124 (1974), No. 11, page 25, Chemiefaser/Textilindustrie, June 1975, page 546).

It is an object of the present invention to provide an economical process for the recovery and re-use of sizes from fabrics of which the warp is sized with water-soluble polymers of acrylic acid.

We have found that this object is achieved and that sizes can be recovered in a simple manner from fabrics of which the warp is sized with water-soluble polymers of acrylic acid and/or their alkali metal salts or ammonium salts, if the fabric is treated with from 30 to 300% by weight of water, based on the dry weight of the fabric, and the size solution thus obtained is separated from the fabric and collected.

The size can be recovered by this process regardless of the nature of the fibrous material. The process is fundamentally as successful with cotton and/or polyester-cotton fabrics as with fully synthetic fabrics or glass fiber fabrics.

Examples of suitable water-soluble polymers of acrylic acid are homopolymers of acrylic acid and their alkali metal salts and ammonium salts. Copolymers of acrylic acid which contain up to 85% by weight of one or more comonomers, as copolymerized units, can also be used, in a partially or completely neutralized form as the corresponding alkali metal salts and ammonium salts. Examples of suitable comonomers are methacrylic acid, maleic acid and fumaric acid, their salts and esters with alcohol of 1 to 4 carbon atoms, acrylonitrile, methacrylonitrile, acrylamine, amethacrylamide and vinylpyrrolidone. Some particularly suitable sizes are described, inter alia, in German Published Application 1,594,904 and in German Laid-Open Application 2,004,676, which are herein incorporated by reference.

The process according to the invention is also applicable to water-soluble polyacrylate sizes which contain starch products which have been converted into a substantially water-soluble form by chemical modification of the starch, e.g. starch ethers or starch esters.

According to the invention, the polyacrylate size is recovered as follows:

First, from 30 to 300, preferably from 50 to 200, percent by weight of water, based on the dry weight of the fabric, are applied to the latter. This may be done for example by dipping or spraying or by allowing the water to trickle onto the fabric. The water should contain no additives and if possible, no impurities, or only small amounts of impurities, e.g. salts. The temperature of the water is from 5° to 95° C, preferably from 10° to 70° C.

The polyacrylate size solution formed is separated from the fabric, preferably after a very short residence time of the water on the fabric, e.g. a residence time of less than 1 minute, preferably from 5 to 50 seconds, by squeezing off, doctoring off and/on suction-draining, and is collected. This process can be repeated once, or several times, to increase the yield of recovered size. On carrying out the process twice only, up to 86% of the polyacrylate size originally present on the fabric were recovered. The surprisingly small amounts of water required in the process of the invention make it possible to obtain the regenerated size in a relatively high concentration, so that it can be used directly and without additional measures, by itself or with additions, for a new sizing operation. The brevity of the period of exposure to water, which — contrary to the view generally held in the textile industry — suffices to recover the size, also makes it possible preferentially to carry out the recovery process continuously.

Apart from the substantial saving of water and size, the most important technical advance achieved by the process is that recovery and re-use of the size permit a drastic reduction in the contamination of the effluent.

The Examples which follow illustrate the invention. In the Examples, parts are by weight.

EXAMPLE 1

293 g of a cotton fabric which contained 8.5 percent by weight of a copolymer — neutralized to the extent of 75% with ammonia — of 85 parts of acrylic acid and 15 parts by acrylonitrile, which had a viscosity of 264 cp, measured on a 10% strength aqueous solution at 20° C, were cut into 6 cm wide strips which were sewn end to end. The fabric tape thus obtained was passed through a trough filled with water at 60° C, the residence time of the tape in the water being about 1.5 seconds. The fabric tape was then squeezed off between two rubber rollers (Shore hardness 80) under a pressure of 3 atmospheres gage. The tape travelled at the rate of about 6 cm/second and the residence time of the fabric in the water from the instant of immersion in the trough to the instant of reaching the roller nip was about 8 seconds. A trough in which the squeezed-off liquor was collected was placed below the pair of rollers. After a single pass of the fabric tape, the trough contained 144 g of an 8% strength by weight aqueous size solution, corresponding to 11.5 parts of recovered size (about 46% of the theoretically recoverable amount of size).

A Nm 68/1 cotton yarn was sized with this regenerated size on a laboratory sizing machine so as to apply 12 percent by weight of size solids to the yarn.

In the same way, cotton was sized with the original size described above, to produce a 12.2% coating.

The yarn which had been sized and conditioned for 24 hours at 20° C and 65% relative atmospheric humidity was subjected to physical tests comprising determination of the breaking load, elongation, rigidity and number of passes, on an abrasion tester, required to cause the yarn to break. The mean values obtained from 20 individual determinations are listed in the Table which follows and compared with the values for the unsized yarn and the values for the yarn sized, in the same manner, with the original size.

TABLE 1

| Size | Amount applied (% by weight) | Abrasion number+) | Breaking load (g) | Elongation at break (%) | Rigidity (mm) |
|---|---|---|---|---|---|
| Untreated | — | 121 | 198 | 5.2 | 45 |
| Original size | 12.2 | 630 | 294 | 4.4 | 86 |
| Regenerated size | 12.0 | 621 | 327 | 4.6 | 89 |

+)Measured according to E. Kenk, Textil Praxis 7 (1952), 698.

The differences in values measured when testing the yarn sized with the original size and the yarn sized with the regenerated size lie within the limits of error of the method of measurement.

The values obtained prove that the recovered size has not lost any of its original quality.

EXAMPLE 2

The warp for the polyester/cotton jacketing poplin fabric identified in more detail in Table 2 was sized with a polyacrylate size which was prepared from 65 parts by weight of acrylic acid and 35 parts by weight of acrylonitrile, and converted to the ammonium salt, in accordance with the teaching of German Laid-Open Application 2,004,676. This polyacrylate size is hereinafter referred to as size A. The sized warp carried 16% by weight (based on dry untreated yarn = 100% of solids of size A. It was woven on a Ruti C loom in a room at 20°–22° C, in which the relative atmospheric humidity was 60–65%.

TABLE 2

| Weaving data of the jacketing poplin fabric | |
|---|---|
| Type of fiber | Polyester/Cotton (65:35) |
| Ends per cm | 49 |
| Picks per cm | 25 |
| Warp yarn | Nm 50/1 |
| Filling yarn | Nm 50/1 |
| Total warp count | 7,580 |
| Construction | linen weave, 1/1 |

About 3,000 m of the jacketing poplin fabric produced from the warp sized as described above, and carrying 10.6 percent by weight of size, were passed through a roller vat containing water at about 55°–60° C so as to provide an immersion time of about 2 seconds and were then continuously squeezed off on a Dornier padder (Shore hardness of the rollers: 70) under a pressure of 3.5 atmospheres. The goods travelled at 45 m/minute and the time from the instant of immersion to the instant of reaching the roller nip was about 10 seconds. A trough, in which the recovered sizing liquor was collected, was placed under the pair of nip rollers. After squeezing off once, the goods still carried about 4.6% by weight of size A, corresponding to a recovery of size A of 57% of theory. The fabric was treated a second time under the same conditions. After this, the goods still carried about 1.5% by weight of size A, corresponding to a total recovery of size A of 86% of theory.

Experiment a

Re-use of the regenerated size for sizing cotton

The collected sizing liquor contained 6 percent by weight of solids of size A. This sizing liquor was brought to the desired concentration of 8% with a concentrated solution of original, non-regenerated size A, and was re-used for sizing Nm 20/1 cotton. The abrasion numbers of the warp sized in this way showed no difference from the data obtained on warp sized with 8% strength original size A.

Experiment b

Re-use of the regenerated size for sizing polyester/cotton warp yarn 2,000 m of Nm 50/1 polyester/cotton (65:35) warp yarn were sized on a Sucker sizing machine with 7 drying cylinders, under the conventional conditions, using a sizing liquor of the formulation shown below, which was prepared in a Turbo-boiler.

| Formulation |
|---|
| 320 l of water |
| 35 kg of 25% strength size A |
| 75 kg of 6% strength regenerated size A |
| 30 kg of starch ester |
| 0.5 kg of fatty acid monoglyceride |
| 500 l of finished liquor |

The sized warp carried 17.2% by weight of size solids and was woven at 75% relative atmospheric humidity and 22° C on a Ruti C loom to give a poplin, the technical data of which are shown in Table 3.

TABLE 3

| Weaving data of the poplin | |
|---|---|
| Type of fiber | polyester/cotton (65:33) |
| Ends per cm | 32 |
| Picks per cm | 25 |
| Warp yarn | Nm 75/1 |
| Filling yarn | Nm 71/1 |
| Total yarn count | 3,956 |
| Construction | linen weave, 1/1 |

A statistical evaluation of the weaving experiment showed 0.06 warp breaks per 1,000 ends and 10,000 picks.

Experiment c

Comparative experiment to Experiment b, with original size A

Sizing was carried out under the same conditions as in Experiment b, but with the following formulation:

| Formulation |
|---|
| 350 l of water |

-continued

| Formulation |
|---|
| 50 kg of 25% strength original size A |
| 30 kg of starch ester |
| 0.5 kg of fatty acid monoglyceride |
| 500 1 of finished liquor |

The sized warp carried 17.2% by weight of size solids and was converted to the same fabric as in Experiment b. A statistical evaluation of the weaving experiment showed 0.07 warp breaks per 1,000 ends and 10,000 picks. Accordingly, both experiments gave the same weaving efficiency.

EXAMPLE 3

A viscose rayon warp for a lining fabric was sized with a 3% strength aqueous solution of a copolymer of 20 parts of sodium acrylate and 80 parts of ethyl acrylate, which had a viscosity of 60 cp, measured on a 10% strength aqueous solution at 20° C, so that the yarn carried 3 percent by weight of size solids. The lining fabric produced from this warp contained 1.8% by weight of size solids.

The fabric was treated with 120% by weight, based on the weight of the dry fabric, of water and after a residence time of 20 seconds was thoroughly squeezed off, and suction-drained. This resulted in the recovery of 72% of a 2% strength sizing liquor, which was re-used directly, without any further measures, for sizing viscose rayon. The weaving characteristics of the warp sized with the recovered material did not differ from those of the viscose warp described above.

We claim:

1. A process for the recovery of a size from a fabric of which the warp is sized with a water-soluble polymer of acrylic acid or an alkali metal salt or ammonium salt thereof, which comprises treating the sized fabric with from 30 to 300 percent by weight of water, based on the dry weight of the fabric, at from 5° to 95° C, separating the resulting size solution from the fabric, and collecting the size.

2. A process as claimed in claim 1, wherein from 50 to 200% by weight of water, based on the dry weight of the fabric, is used at from 10° to 70° C.

3. A process as claimed in claim 1, wherein the residence time of the water on the fabric is less than 1 minute and the water feed and separation of the size solution are continuous.

4. A process as claimed in claim 1, wherein the collected size solution as such is re-used for sizing other warp yarn.

5. A process as claimed in claim 1, wherein the fabric is a cotton or cotton-polyester fabric.

6. A process as claimed in claim 1, wherein the fabric is a fully synthetic fabric or glass fiber fabric.

7. A process as claimed in claim 1, wherein the water used is free not only from additives but also from impurities.

8. A process as claimed in claim 1, wherein the residence time of the water on the fabric is 5 to 50 seconds.

9. A process as claimed in claim 1, wherein the residence time of the water on the fabric is less than 1 minute.

10. A process for the recovery and re-use of a size from a fabric in which the warp is sized with a water soluble polymer of acrylic acid on an alkali metal or ammonium salt thereof, which comprises contacting the sized fabric with from 30 to 300 percent by weight, based on the dry weight of the fabric, of water containing no additives and at most small amounts of impurities at 5° to 95° C for a period of less than 1 minute to form a regenerated aqueous size solution, separating the regenerated size solution from the fabric, using the regenerated size solution directly and as such as to make another aqueous sizing solution of said water soluble polymer, and using the latter sizing solution to size additional warp yarn.

* * * * *

UNITED STATES PATENT AND TRADEMARK OFFICE

CERTIFICATE OF CORRECTION

PATENT NO. : 4,095,947

DATED : June 20, 1978

INVENTOR(S) : HANS WOLF et al

It is certified that error appears in the above-identified patent and that said Letters Patent are hereby corrected as shown below:

Col. 6, line 35, delete "as" (second occurrence)

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*